US007691795B2

(12) United States Patent
Nolan et al.

(10) Patent No.: US 7,691,795 B2
(45) Date of Patent: Apr. 6, 2010

(54) METAL HYDROXIDE DESICCATED EMULSIONS USED TO PREPARE GREASE

(75) Inventors: Stephen J. Nolan, Derby (GB); Carl F. Kernizan, Shaker Hts., OH (US); Paul S. Greenfield, West Hallam (GB); Claire L. Hollingshurst, Belper (GB)

(73) Assignee: The Lubrizol Corporation, Wickliffe, OH (US)

( * ) Notice: Subject to any disclaimer, the term of this patent is extended or adjusted under 35 U.S.C. 154(b) by 1279 days.

(21) Appl. No.: 10/529,956

(22) PCT Filed: Aug. 14, 2003

(86) PCT No.: PCT/US03/25447

§ 371 (c)(1),
(2), (4) Date: Aug. 5, 2005

(87) PCT Pub. No.: WO2004/031328

PCT Pub. Date: Apr. 15, 2004

(65) Prior Publication Data

US 2006/0100292 A1 May 11, 2006

(51) Int. Cl.
*C10M 129/26* (2006.01)
*C10M 133/16* (2006.01)

(52) U.S. Cl. ..... 508/459; 508/506

(58) Field of Classification Search ..... 508/459, 508/506

See application file for complete search history.

(56) References Cited

U.S. PATENT DOCUMENTS

| | | | | |
|---|---|---|---|---|
| 2,654,710 | A | 10/1953 | Hotten | 252/37.2 |
| 3,647,690 | A * | 3/1972 | Cross | 508/311 |
| 4,315,825 | A | 2/1982 | Schweitzer et al. | 252/41 |
| 5,498,357 | A * | 3/1996 | Naka et al. | 508/176 |
| 6,153,563 | A | 11/2000 | Smith et al. | 508/154 |
| 6,525,007 | B2 | 2/2003 | Okada et al. | 508/591 |

FOREIGN PATENT DOCUMENTS

| | | |
|---|---|---|
| GB | 837429 | 6/1960 |
| GB | 1076845 | 7/1967 |

* cited by examiner

*Primary Examiner*—Glenn Caldarola
*Assistant Examiner*—Jim Goloboy
(74) *Attorney, Agent, or Firm*—Samuel B. Laferty; David M. Shold; Christopher D. Hilken

(57) ABSTRACT

The invention provides a grease composition comprising a stable dispersion of a metal hydroxide with a number average particle size in the range 20 nanometres to 2 micrometres, a surfactant with a HLB of less than 10, a mono- or poly-carboxylic acid, and an oil of lubricating viscosity. The method of preparing a grease composition is also disclosed with benefits including a reduction in reaction time, amount of foam produced and environmental hazards.

19 Claims, 1 Drawing Sheet

Temperature Programmed Thermal Analysis of Emulsions of Lithium Hydroxide and Lithium Hydroxide Monohydrate

Figure 1: Temperature Programmed Thermal Analysis of Emulsions of Lithium Hydroxide and Lithium Hydroxide Monohydrate
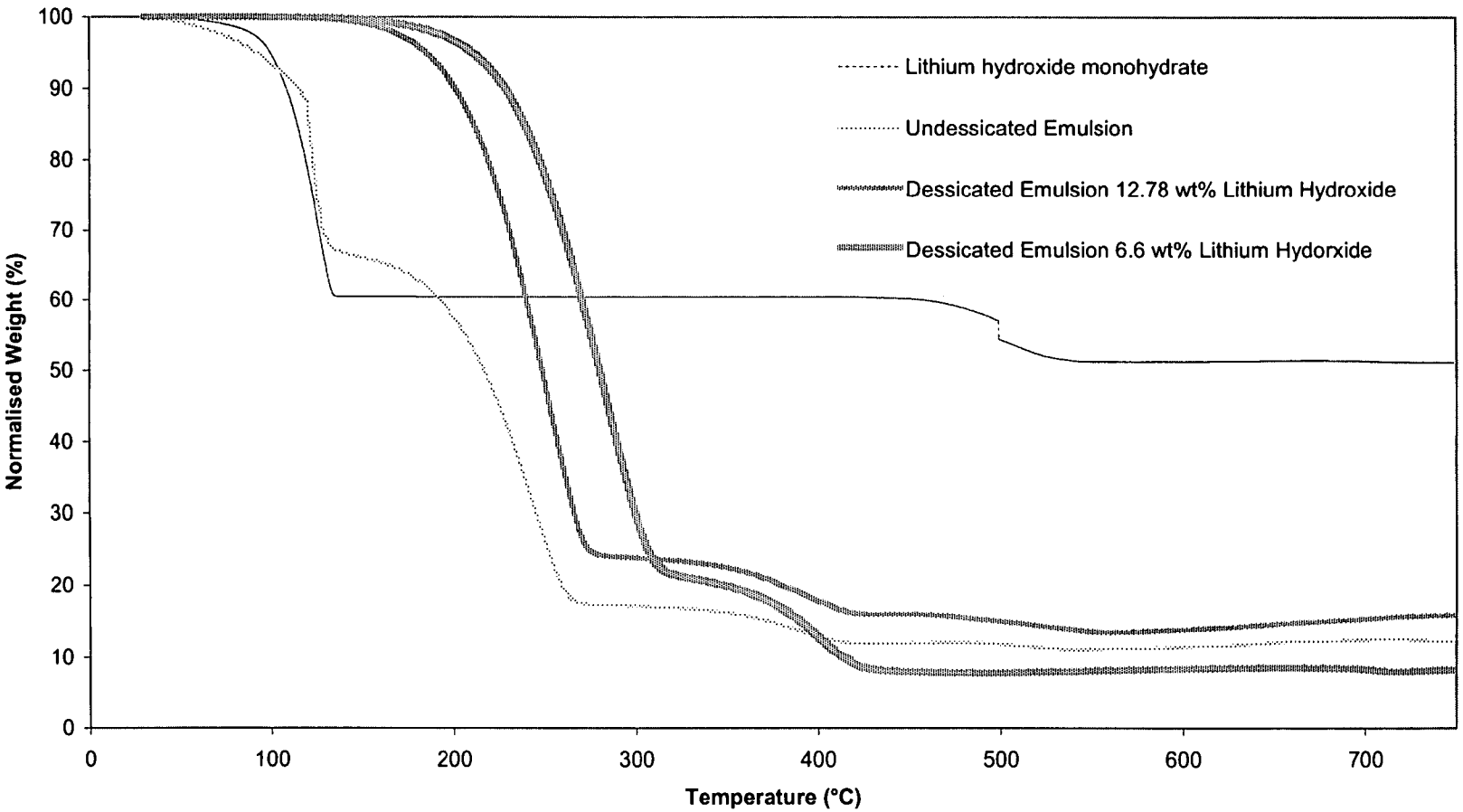

METAL HYDROXIDE DESICCATED EMULSIONS USED TO PREPARE GREASE

FIELD OF THE INVENTION

The invention relates to a method of preparing soap thickened lubricating greases using a base in the form of a desiccated base e.g. lithium dispersion. The use of a desiccated metal hydroxide emulsion technology to make the lithium dispersion allows greases to be prepared under milder conditions.

BACKGROUND OF THE INVENTION

It is well known that grease manufacturing can be either continuous or non-continuous. Both processes react solid or aqueous base e.g. lithium hydroxide monohydrate with carboxylic acids in the presence of mineral oil. The reaction of lithium hydroxide monohydrate and the carboxylic acid acts to thicken the mineral oil to produce straight lithium greases. The most commonly used carboxylic acid used in the manufacture of grease is 12-hydroxystearic acid.

Non-continuous and continuous processes to prepare said greases require high temperatures for saponification and high pressure vessels.

U.S. Pat. No. 2,434,539 relates to a continuous method of preparing anhydrous grease by initially dehydrating metal hydroxide before addition into a slurry with high molecular weight fatty acid.

U.S. Pat. No. 2,444,720 relates to the manufacture of lubricants containing lithium grease by intimately reacting anhydrous lithium hydroxide or lithium hydroxide monohydrate with fatty acids at a temperature in the range 35 to 45° C. for sufficient time for 90 weight percent of lithium and fatty acid compounds to form a grease.

U.S. Pat. No. 2,659,695 relates to the preparation of a grease from an insoluble metal hydroxide and a fatty acid with a water in oil emulsion containing petroleum mahogany sulfonates dissolved in mineral oil.

U.S. Pat. Nos. 2,708,659 and 2,868,729 relate to methods of preparing grease by initially dissolving calcium hydroxide in lubricating oil before the addition of the appropriate organic acid. The organic acid used in U.S. Pat. No. 2,868,729 is a substituted alkenyl succinic acid, whereas U.S. Pat. No. 2,708,659 uses acids such as stearic, oleic, tallow etc.

U.S. Pat. No. 4,075,234 relates to grease manufacture using a concentrated aqueous solution of lithium hydroxide in a liquid reaction mixture comprising an alkyl nitrile.

U.S. Pat. No. 4,337,209 relates to a method of preparing soap and greases by reacting an organic carboxylic acid, its esters and mixtures thereof with a concentrated aqueous solution of alkali metal hydroxide in the presence of an inorganic salt, in a liquid reaction medium comprising acetone. The presence of the inorganic salt increases the yield of the soap or grease.

U.S. Pat. No. 5,236,607 relates to a process for preparing a lithium soap thickened grease which consists of heating a mixture of oil and a lithium base to at least 100° C., then heating the resulting mixture at a temperature in the range of 110° C. to 200° C. until a thickened grease is obtained.

U.S. Pat. No. 5,948,736 relates to a method of forming a dust free lithium hydroxide monohydrate by coating said hydroxide with 0.1 to 5 weight percent of low melting point or liquid fatty acids or esters. Triglycerides of fatty acids may also be used to coat lithium hydroxide monohydrate. Typically, the liquid fatty acids or esters of the invention have a melting point less than 38° C.

U.S. Pat. No. 6,153,563 relates to a method of decreasing environmental hazards associated with lithium hydroxide monohydrate or anhydrous lithium hydroxide in grease manufacture. The technology makes use of a sealed pouch of a single layer polyolefin film having a thickness of 0.0005 to 0.001 inches capable of melting below 138° C. The polyolefin is soluble in a lubricating oil base. The sealed pouch contains said hydroxide or lithium fatty acid or mixtures thereof for use in preparation of grease.

The "NLGI Lubricating Grease Guide, $2^{nd}$ Edition, 1989" discloses water free (anhydrous) calcium greases prepared by reacting 12-hydroxystearic acid with lime in the presence of oil in the absence of a surfactant.

It would be desirable to have a grease composition and a manufacturing process having minimal environmental hazardous e.g. low dust or vapour and producing less foam. Furthermore it would be desirable if the process produced a higher yield value using less energy and raw materials.

BRIEF DESCRIPTION OF THE DRAWINGS

FIG. 1 is Temperature Programmed Thermal Analysis of Emulsions of Lithium Hydroxide and Lithium Hydroxide Monohydrate.

SUMMARY OF THE INVENTION

The present invention provides a grease composition comprising the reaction product of:

(a) a stable dispersion of a metal hydroxide with a number average particle size in the range of about 20 nanometres to about 2 micrometres;

(b) a surfactant with a HLB of less than about 10;

(c) a carboxylic acid containing about 2 to about 30 carbon atoms, wherein the carboxylic acid is selected from a monocarboxylic acid, polycarboxylic acid and mixtures thereof, optionally the carboxylic acid is further substituted with groups selected from a hydroxyl group, an ester and mixtures thereof; and (d) an oil of lubricating viscosity.

The invention further provides a manufacturing process for grease with reduced environmental hazards e.g. dust or vapour. The invention further provides a method of preparing grease with an increase yield of viscosity modifying metal soap (salt) per gram of metal and/or carboxylic acid. The invention further provides a metal hydroxide that is substantially anhydrous. The invention further provides a process for grease manufacture resulting in a significant reduction in the amount of foam. The invention further provides a process for producing grease with a significantly shorter reaction time than current processes. The invention further provides a method of preparing grease with reduced environmental hazards, a reduced reaction time, less foam and increased grease yield values.

DETAILED DESCRIPTION OF THE INVENTION

It has been found that a grease composition comprising the reaction product of:

(a) a stable dispersion of a metal hydroxide with a number average particle size in the range of about 20 nanometres to about 2 micrometres;

(b) surfactant with a HLB of less than about 10;

(c) a carboxylic acid containing about 2 to about 30 carbon atoms, wherein the carboxylic acid is selected from a monocarboxylic acid, polycarboxylic acid and mixtures thereof, optionally the carboxylic acid is further substituted with groups selected from a hydroxyl group, an ester and mixtures thereof; and (d) an oil of lubricating viscosity.

Metal Hydroxide

Stable dispersions of metal hydroxides herein is meant to encompass finely dispersed metal hydroxide particles which remain substantially in suspension (e.g. colloidally stable) for at least one day, preferably one week, more preferably at least two months, even more preferably at least six months and most preferably one year or more.

Stable dispersions of metal hydroxides of the invention have a number average particle size in the range of about 20 nanometres to about 2 micrometres, preferably about 40 nanometres to about 1.5 micrometres, more preferably about 40 nanometres to about 1 micrometres, even more preferably about 75 nanometres to about 1 micrometres, even more preferably about 100 to about 600 nanometres, even more preferably about 150 to about 550 nanometres and most preferably about 200 to about 500 nanometres.

Stable dispersions of metal hydroxides of the invention are typically present at about 1 to about 50, preferably about 5 to about 40 and more preferably about 8 to about 30 weight percent of the grease composition.

The metal hydroxide is a mono- or di- or tri-valent metal or a mixture thereof. Preferably the metal hydroxide is an alkali metal, an alkaline earth metal, aluminium or a mixture thereof. More preferably the alkali metal hydroxide is lithium, sodium, potassium and the alkaline earth metal is calcium, magnesium or barium. Most preferably, the metal hydroxide is lithium hydroxide monohydrate, calcium hydroxide or mixtures thereof. In one embodiment the metal hydroxide is lithium hydroxide monohydrate and can be solid or aqueous, although aqueous is preferred. In one embodiment the metal hydroxide is calcium hydroxide. In one embodiment the metal hydroxide is free of calcium hydroxide. The metal hydroxide can be used alone or in combination.

The metal hydroxide of the invention is in the form of $M(OH)_{1-3}.xH_2O$, wherein M is a mono- or di- or tri-valent metal ion; "1-3" means 1, 2, or 3 hydroxyl groups, and x can be a fraction in the range 0 to 1. When x=1 the metal hydroxide is in the form of the monohydrate. When x is greater than zero and less than 1, the metal hydroxide is partially, substantially or wholly anhydrous. Partially anhydrous metal hydroxide is when x is in the range about 0.9 to about 0.5, preferably about 0.85 to about 0.55, most preferably about 0.6 to about 0.7. Substantially anhydrous metal hydroxide has x less than about 0.5, preferably less than about 0.3, even more preferably less than about 0.1 but greater than about 0.02. Wholly anhydrous metal hydroxide has x in the range about 0.02 to about 0, preferably x is in the range about 0.01 to about 0, even more preferably x is about 0. Most preferably the metal hydroxide is substantially or wholly anhydrous.

The amount of the dispersion of metal hydroxide in oil present in the invention is generally in the range about 0.5 to about 20, preferably about 1 to about 15, more preferably about 3 to about 12, and most preferably about 4 to about 10 weight percent based on the weight of the grease if fairly concentrated metal hydroxide dispersions are used to make the grease. The metal hydroxide can be from about 1 or about 5 wt. % to about 60 wt. % of the dispersion depending on a variety of conditions that affect the amount of dispersed phase. Multiple emulsifications of a metal hydroxide solution into the oil, followed by desiccation can increase the metal hydroxide concentration. Also the dispersion can be diluted with oil. All components of the grease listed hereafter will be based on the weight of the grease unless specified otherwise.

The lithium hydroxide used in the prior art is usually commercially available solid monohydrates. This solid produces a dust when handled which causes choking and is extremely irritating, even in trace amounts. Large amounts of lithium hydroxide monohydrate are used in the continuous or non-continuous manufacture of lithium grease and the irritating dust is an environmental hazard during handling and mixing operations. Furthermore, bulk powders of lithium hydroxide monohydrate can easily be spilled by the user, causing waste, as well as possible respiratory irritation. Also, waste can occur while loading the reactor through spillage, resulting in an insufficient charge, yielding a grease composition having a total metal soap concentration below the desired specifications.

The granules or powders of lithium hydroxide monohydrate of the prior art with number average particle size above about 2 or about 5 micrometres have a tendency to agglomerate and cake after contact with water or when stored in areas of high humidity. This caking diminishes the amount of exposed surface area that can be initially contacted by the lubricating oil base stock during the saponification reaction; thereby slowing the reaction. The caking of the lithium hydroxide and the severe reaction conditions result in a low production capacity and the use of excessive amounts of energy and extended reaction times. Current continuous or non-continuous processes also tend to produce excessive amounts of foam.

Surfactants

The surfactants of the desiccated emulsion or dispersion have emulsifier and/or dispersant properties and comprise ionic or non-ionic compounds, having a hydrophilic lipophilic balance (HLB) in the range less than about 10, desirably about 1 to about 8, and most preferably about 2.5 to about 6. Those skilled in the art will appreciate that combinations of surfactants may be used with individual HLB values outside of the ranges about 1 to about 8 or about 2.5 to about 6, provided that the composition of the final surfactant blend is within these ranges. The amount of the surfactant to form the metal hydroxide dispersion in oil in the final grease can be about 1 or about 2 wt. % based on the weight of the metal hydroxide to about 100 or about 200 wt. % based on the metal hydroxide component in the grease.

Examples of these surfactants suitable for the invention are disclosed in *McCutcheon's Emulsifiers and Detergents,* 1993, North American & International Edition. Generic examples include alkanolamides, alkylarylsulfonates, amine oxides, poly(oxyalkylene) compounds, including block copolymers comprising alkylene oxide repeat units (e.g., Pluronic™), carboxylated alcohol ethoxylates, ethoxylated alcohols, ethoxylated alkyl phenols, ethoxylated amines and amides, ethoxylated fatty acids, ethoxylated fatty esters and oils, fatty esters, glycerol esters, glycol esters, imidazoline derivatives, lecithin and derivatives, lignin and derivatives, monoglycerides and derivatives, olefin sulfonates, phosphate esters and derivatives, propoxylated and ethoxylated fatty acids or alcohols or alkyl phenols, sorbitan derivatives, sucrose esters and derivatives, sulfates or alcohols or ethoxylated alcohols or fatty esters, polyisobutylene succinicimide and derivatives, sulfonates of dodecyl and tridecyl benzenes or condensed naphthalenes or petroleum, sulfosuccinates and derivatives, and tridecyl and dodecyl benzene sulfonic acids.

In one embodiment the surfactant of the invention is an alkylated benzene sulfonate of an alkali metal or alkaline earth metal. The alkyl group contains 8 to 20 and most preferably 10 to 15 carbon atoms. Most preferably the alkyl group is dodecyl. The alkali metal is lithium, potassium or sodium; whereas the alkaline earth metal is calcium or magnesium. Most preferably the metal is calcium.

The surfactant can further include derivatives of a polyolefin. Typical polyolefins can include but are not limited to a polyisobutene; polypropylene; polyethylene; a copolymer derived from isobutene and butadiene; a copolymer derived from isobutene and isoprene; or mixtures thereof.

In one embodiment the polyolefin is a derivative of polyisobutene with a number average molecular weight of at least about 250, 300, 500, 600, 700, or 800, to 5000 or more, often up to about 3000, 2500, 1600, 1300, or 1200. Typically, less than about 5% by weight of the polyisobutylene used to make the succan derivative molecules have $\overline{Mn}$ less than about 250, more often the poly-isobutylene used to make the succan derivative has $\overline{Mn}$ of at least about 800. The polyisobutylene used to make the succan derivative preferably contains at least about 30% terminal vinylidene groups, more often at least about 60% and more preferably at least about 75% or about 85% terminal vinylidene groups. The polyisobutylene used to make the succan derivative may have a polydispersity, $\overline{Mw}/\overline{Mn}$, greater than about 5, more often from about 6 to about 20.

In one embodiment, the polyisobutene is substituted with succinic anhydride, the polyisobutene substituent having a number average molecular weight of about 1,500 to about 3,000, in one embodiment about 1,800 to about 2,300, in one embodiment about 700 to about 1300, in one embodiment about 800 to about 1000, said first polyisobutene-substituted succinic anhydride being characterized by about 1.3 to about 2.5, and in one embodiment about 1.7 to about 2.1 In one embodiment, the hydrocarbyl-substituted carboxylic acid acylating agent is a polyisobutene-substituted succinic anhydride, the polyisobutene substituent having a number average molecular weight of about 1,500 to about 3,000, and in one embodiment about 1,800 to about 2,300, said first polyisobutene-substituted succinic anhydride being characterized by about 1.3 to about 2.5, and in one embodiment about 1.7 to about 2.1, in one embodiment about 1.0 to about 1.3, and in one embodiment about 1.0 to about 1.2 succinic groups per equivalent weight of the polyisobutene substituent.

In one embodiment the surfactant is polyisobutenyl-dihydro-2,5-furandione ester with pentaerythritol or mixtures thereof. In one embodiment of the invention is a polyisobutylene succan derivative such as a polyisobutylene succinicimide or derivatives.

Other typical derivatives of polyisobutylene succans include hydrolyzed, esters or diacids. Polyisobutylene succan derivatives are preferred to make the metal hydroxide dispersions. A large group of polyisobutylene succan derivatives are taught in U.S. Pat. No. 4,708,753, herein incorporated by reference.

Mono or Poly-Carboxylic Acid(s)

The carboxylic acid may be any combination of a mono- or poly-carboxylic; branched alicyclic, or linear, saturated or unsaturated, mono- or poly-hydroxy substituted or unsubstituted carboxylic acid, acid chloride or the ester of said carboxylic acid with an alcohol such as an alcohol of about 1 to about 5 carbon atoms. The carboxylic acid has about 2 to about 30, preferably about 4 to about 30, more preferably about 8 to about 27, even more preferably about 12 to about 24 and most preferably about 16 to about 20 carbon atoms. In one embodiment the carboxylic acid is a monocarboxylic acid or mixtures thereof. In one embodiment the carboxylic acid is a dicarboxylic acid or mixtures thereof. In one embodiment the carboxylic acid is an alkanoic acid. In one embodiment the carboxylic acid is a mixture of dicarboxylic acid and monocarboxylic acid typically in the weight percent ratio of about 99:1, 70:30, 50:50, 40:60, 35:65, 30:70, 25:75, 20:80, 15:85, 10:90, 5:95 or 1:99. Dicarboxylic acids tend to be more expensive than monocarboxylic acids and as a consequence, most industrial processes using mixtures preferably use a ratio of dicarboxylic acid to monocarboxylic acid in the range about 30:70, 25:75, 20:80, 15:85.

The monocarboxylic acids having this number of carbon atoms are generally associated with an HLB (hydrophile to lipophile balance) of about 10 or more, preferably about 12 or more and more preferably about 15 or more when converted to their salt form. Generally an HLB of about 10 or more is associated with significant attraction to the water phase (hydrophilic) relative to the attraction for the lipophilic phase (oil phase).

In one preferred embodiment the carboxylic acids are hydroxy substituted or unsubstituted alkanoic acids. Typically, the carboxylic acids will have about 2 to about 30, preferably about 4 to about 30, more preferably about 12 to about 24 and most preferably about 16 to about 20 carbon atoms. Preferably the carboxylic acid is a hydroxystearic acid or esters of these acids such as 9-hydroxy, 10-hydroxy or 12-hydroxy, stearic acid, and most preferably 12-hydroxy stearic acid.

Other saturated carboxylic acids suitable for the invention include capric acid, lauric acid, myristic acid, palmitic acid, arachidic acid, behenic acid and lignoceric acid.

Unsaturated carboxylic acids suitable for the invention include undecylenic acid, myristoleic acid, palmitoleic acid, oleic acid, gadoleic acid, elaidic acid, cis-eicosenoic acid, erucic acid, nervonic acid, 2,4-hexadienoic acid, linoleic acid, 12-hydroxy tetradecanoic acid, 10-hydroxy tetradeconoic acid, 12-hydroxy hexadecanoic acid, 8-hydroxy hexadecanoic acid, 12-hydroxy icosanic acid, 16-hydroxy icosanic acid 11,14-eicosadienoic acid, linolenic acid, cis-8,11,14-eicosatrienoic acid, arachidonic acid, cis-5,8,11,14,17-eicosapentenoic acid, cis-4,7,10,13,16,19-docosahexenoic acid, all-trans-retinoic acid, ricinoleic acid lauroleic acid, eleostearic acid, licanic acid, citronelic acid, nervonic acid, abietic acid, and abscisic acid. Most preferred acids are palmitoleic acid, oleic acid, linoleic acid, linolenic acid, licanic acid and eleostearic acid.

Polycarboxylic acids, especially dicarboxylic acids are present in complex greases and suitable examples include but are not limited to iso-octanedioic acid, octanedioic acid, nonanedioic acid (azelaic acid), decanedioic acid (sebacic acid), undecanedioic acid, dodecanedioic acid, tridecanedioic acid, tetradecanedioic acid, pentadecanoic acid and mixtures thereof. In one embodiment the polycarboxylic acid is nonanedioic acid (azelaic acid) or mixtures thereof. In one embodiment the polycarboxylic acid is decanedioic acid (sebacic acid) or mixtures thereof.

The amount of mono- or poly-carboxylic acid present in the invention is typically in the range about 0.1 to about 30, preferably about 3 to about 30, more preferably about 3 to about 25, even more preferably about 4 to about 20, and most preferably about 5 to about 18 weight percent of the grease composition.

When present the amount of polycarboxylic acid is typically in the range about 0.1 to about 15, preferably about 0.3 to about 12, more preferably about 0.7 to about 8, and most preferably about 1 to about 6 weight percent. In one embodiment the polycarboxylic acid is about 1.7 weight percent of the grease composition. In one embodiment the polycarboxylic acid is about 3 weight percent of the grease composition.

In one embodiment the polycarboxylic acid is about 4 weight percent of the grease composition.

Oil of Lubricating Viscosity

The lubricating compositions and functional fluids of the present invention are based on diverse oils of lubricating viscosity, including natural and synthetic lubricating oils and mixtures thereof. Synthetic oils may be produced by Fischer-Tropsch reactions including oils formed from gas to liquid reactions.

Natural oils useful in making the inventive lubricants and functional fluids include animal oils and vegetable oils (e.g., castor oil, lard oil) as well as mineral lubricating oils such as liquid petroleum oils and solvent-treated or acid-treated mineral lubricating oils of the paraffinic, naphthenic or mixed paraffinic-naphthenic types. Oils of lubricating viscosity derived from coal or shale are also useful. Synthetic lubricating oils are useful and include hydrocarbon oils such as polymerized and interpolymerized olefins (e.g., polybutylenes, polypropylenes, propyleneisobutylene copolymers); poly(1-hexenes), poly(1-octenes), poly(1-decenes), and mixtures thereof; alkyl-benzenes (e.g., dodecylbenzenes, tetradecylbenzenes, dinonylbenzenes, di-(2-ethylhexyl)-benzenes); polyphenyls (e.g., biphenyls, terphenyls, alkylated polyphenyls); alkylated diphenyl ethers and alkylated diphenyl sulfides and the derivatives, analogs and homologs thereof.

Alkylene oxide polymers and interpolymers and derivatives thereof where the terminal hydroxyl groups have been modified by esterification, and etherification, constitute another class of known synthetic lubricating oils that can be used. These are exemplified by the oils prepared through polymerization of ethylene oxide or propylene oxide, the alkyl and aryl ethers of these polyoxyalkylene polymers (e.g., methyl-polyisopropylene glycol ether having a number average molecular weight of 1000, diphenyl ether of polyethylene glycol having a molecular weight of 500-1000, diethyl ether of polypropylene glycol having a molecular weight of 1000-1500) or mono- and polycarboxylic esters thereof, for example, the acetic acid esters, mixed $C_{3-8}$ fatty acid esters, or the $C_{13}$ Oxo acid diester of tetraethylene glycol.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, and alkenyl malonic acids) with a variety of alcohols (e.g., butyl alcohol, hexyl alcohol, dodecyl alcohol, 2-ethylhexyl alcohol, ethylene glycol, diethylene glycol monoether, and propylene glycol) Specific examples of these esters include dibutyl adipate, di-(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols such as neopentyl glycol, trimethylol propane, and pentaerythritol, or polyol ethers such as dipentaerythritol, and tripentaerythritol.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl) silicate, tetra-(4-methylhexyl)silicate, tetra-(p-tert-butylphenyl) silicate, hexyl-(4-methyl-2-pentoxy) disiloxane, poly(methyl)siloxanes, and poly-(methylphenyl) siloxanes). Other synthetic lubricating oils include liquid esters of phosphorus-containing acids (e.g., tricresyl phosphate, trioctyl phosphate, and the diethyl ester of decane phosphonic acid), and polymeric tetrahydrofurans.

Unrefined, refined and re-refined oils, either natural or synthetic (as well as mixtures of two or more of any of these) of the type disclosed hereinabove can be used in the lubricants of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, re-refined oils are obtained by processes similar to those used to obtain refined oils applied to refined oils which have been already used in service. Such re-refined oils are also known as reclaimed or reprocessed oils and often are additionally processed by techniques directed to removal of spent additives and oil breakdown products.

Oils of lubricating viscosity can also be defined as specified in the American Petroleum Institute (API) Base Oil Interchangeability Guidelines. The five base oil groups are as follows:

| Base Oil Category | Sulfur (%) | | Saturates (%) | Viscosity Index |
|---|---|---|---|---|
| Group I | >0.03 | and/or | <90 | 80-120 |
| Group II | ≦0.03 | and | ≧90 | 80-120 |
| Group III | ≦0.03 | and | ≧90 | ≧120 |
| Group IV | All polyalphaolefins (PAOs) | | | |
| Group V | All others not included in Groups I, II, III, or IV | | | |

Groups I, II, and III are mineral oil base stocks. Preferably the oil of lubricating viscosity is a Group I, II, III, IV, or V oil or mixtures thereof. More preferably, the oil of lubricating viscosity is a Group I, II or III oil or mixtures thereof. In one embodiment the oil of lubricating viscosity is Group I. In one embodiment the oil of lubricating viscosity is Group III.

The amount of oil of lubricating viscosity is present in the range 50 to 96.5, preferably 60 to 94, more preferably 68 to 90 and most preferably 72 to 86 weight percent.

Optional Grease Additives

Metal Deactivators

Metal deactivators useful in lubricating oil compositions are known in the art and include derivatives of benzotriazoles, benzimidazole, 2-alkyldithiobenz-imidazoles, 2-alkyldithiobenzothiazoles, 2-(N,N-dialkyldithiocarbamoyl)-benzothiazoles, 2,5-bis(alkyl-dithio)-1,3,4-thiadiazoles, 2,5-bis (N,N-dialkyldithio-carbamoyl)-1,3,4-thiadiazoles, 2-alkyldithio-5-mercapto thiadiazoles or mixtures thereof.

A particularly preferred class of metal deactivators are benzotriazoles. The benzotriazole compounds include hydrocarbyl substitutions at one or more of the following ring positions 1- or 2- or 4- or 5- or 6- or 7-benzotriazoles. The hydrocarbyl groups contain 1 to about 30 carbons, more preferably 1 to about 15 carbons; even more preferably 1 to about 7 carbons and, most preferably the metal deactivator is 5-methylbenzotriazole.

The metal deactivators are present in the range of 0 to about 5 weight percent. More preferably metal deactivators are present in the range about 0.0002 to about 2 weight percent. Most preferably metal deactivators are present in the range about 0.001 to about 1 weight percent.

The Antioxidant

Antioxidants suitable for the invention include a variety of chemical types including phenate sulfides, phosphosulfurized terpenes, sulfurized esters, aromatic amines, and hindered phenols.

A particularly preferred antioxidant is alkylated sterically hindered phenols. Typically the alkylated groups are independently branched or linear alkyl groups containing 1 up to about 24 carbon atoms, preferably about 4 to about 18 carbon atoms and most preferably from about 4 to about 12 carbon atoms. Alkylated groups may be either straight chained or branched chained; branched chained is generally preferred. Preferably the phenol is a butyl substituted phenol containing 2 t-butyl groups. When the t-butyl groups occupy the 2,6-position, that is, the phenol is sterically hindered. Additionally the phenols may have additional substitution in the form of a hydrocarbyl, or a bridging group between two such aromatic groups. Bridging groups in the para position include —$CH_2$— (methylene bridge) and —$CH_2OCH_2$— (ether bridge).

Another class of preferred antioxidants is diphenylamines. These compounds can be represented by the formula:

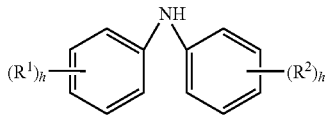

wherein $R^1$ and $R^2$ are independently a hydrogen or an arylalkyl group or a linear or branched alkyl group containing 1 to about 24 carbon atoms and h is independently 0, 1, 2, or 3, provided that at least one aromatic ring contains an arylalkyl group or a linear or branched alkyl group. Preferably $R^1$ and $R^2$ are alkyl groups containing from about 4 to about 20 carbon atoms. A preferred embodiment is an alkylated diphenylamine such as mono- or di-nonylated diphenylamine.

Antioxidants are present in the range of about 0 to about 12 weight percent. More preferably antioxidants are present in the range of about 0.1 to about 6 weight percent. Most preferably antioxidants are present in the range of about 0.25 to about 3 weight percent.

Antiwear Agents

The lubricant may additionally contain an antiwear agent. Useful antiwear agents include but are not limited to a metal thiophosphate, especially a zinc dialkyldithiophosphate; a phosphoric acid ester or salt thereof; a phosphite; and a phosphorus-containing carboxylic ester, ether, or amide. A more detailed discussion and examples of phosphorus containing compounds suitable as antiwear agents is discussed in European patent 612 839.

Rust Inhibitors

Rust inhibitors are known in the art and include metal sulfonates such as calcium sulfonate or magnesium sulfonate, amine salts of carboxylic acids such as octylamine octanoate, condensation products of dodecenyl succinic acid or anhydride and a fatty acid such as oleic acid with a polyamine, e.g. a polyalkylene polyamine such as triethylenetetramine, and half esters of alkenyl succinic acids in which the alkenyl radical contains 8 to 24 carbon atoms with alcohols such as polyglycols.

The rust inhibitors are present in the range of about 0 to about 4 weight percent. More preferably the rust inhibitors are present in the range of about 0.02 to about 2 weight percent. Most preferably the rust inhibitors are present in the range of about 0.05 to about 1 weight percent.

Viscosity Modifiers

Viscosity modifiers are known and are typically polymeric materials including styrene-butadiene rubbers, ethylene-propylene copolymers, polyisobutenes, hydrogenated styrene-isoprene polymers, hydrogenated radical isoprene polymers, polymethacrylate acid esters, polyacrylate acid esters, polyalkyl styrenes, alkenyl aryl conjugated diene copolymers, polyolefins, polyalkylmethacrylates, esters of maleic anhydride-styrene copolymers and mixtures thereof.

Some polymers can also be described as dispersant viscosity modifiers (often referred to as DVM) because they also exhibit dispersant properties. Typically polymers of this type include polyolefins, for example, ethylene-propylene copolymers that have been functionalized with the reaction product of maleic anhydride and an amine. Another type of polymer is a polymethacrylate functionalized with an amine.

The viscosity modifiers are present in the range of about 0 to about 10 weight percent. More preferably the rust inhibitors are present in the range of about 0.5 to about 7 weight percent. Most preferably the rust inhibitors are present in the range of about 1 to about 5 weight percent.

Extreme Pressure Agents

Extreme pressure (EP) agents that are soluble in the oil include a sulfur or chlorosulfur EP agent, a chlorinated hydrocarbon EP agent, or a phosphorus EP agent, or mixtures thereof. Examples of such EP agents are chlorinated wax, organic sulfides and polysulfides, such as benzyldisulfide, bis-(chlorobenzyl) disulfide, dibutyl tetrasulfide, sulfurized sperm oil, sulfinurized methyl ester of oleic acid, sulfurized alkylphenol, sulfurized dipentene, sulfurized terpene, and sulfurized Diels-Alder adducts; phosphosulfurized hydrocarbons, such as the reaction product of phosphorus sulfide with turpentine or methyl oleate, phosphorus esters such as the dihydrocarbon and trihydrocarbon phosphites, i.e., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite, metal thiocarbamates, such as zinc dioctyldithiocarbamate and barium heptylphenol diacid, such as zinc dicyclohexyl phosphorodithioate and the zinc salts of a phosphorodithioic acid combination may be used.

The oil soluble extreme pressure agents are present in the range of about 0 to about 10 weight percent. More preferably the extreme pressure agents are present in the range about 0.25 to about 5 weight percent. Most preferably extreme pressure agents are present in the range about 0.5 to about 2.5 weight percent.

The invention further provides a method of producing a grease composition comprising mixing in any order:

(a) a stable dispersion of metal hydroxide present in the range about 0.5 to about 20 weight percent prepared by removing the solvent from an emulsion of metal hydroxide and solvent in oil;

(b) a carboxylic acid containing about 2 to about 30 carbon atoms, wherein the carboxylic acid is selected from a monocarboxylic acid, polycarboxylic acid and mixtures thereof, optionally the carboxylic acid is further substituted with groups selected from a hydroxyl group, an ester and mixtures thereof present in the range about 0.1 to about 30 weight percent, (c) and an oil of lubricating viscosity present in the range about 50 to about 96.5 weight percent to obtain a mixture, said mixture is further treated with a saponification stage and (d) optionally a finishing amount of oil of lubricating viscosity is added to impart the desired viscosity.

The invention further provides a process to prepare a solid grease thickener comprising the reaction product of:

a) a stable dispersion of a metal hydroxide with a number average particle size in the range about 20 nanometres to about 2 micrometres;

b) a surfactant with a HLB of less than about 10;

c) a carboxylic acid containing about 2 to about 30 carbon atoms, wherein the carboxylic acid is selected from a monocarboxylic acid, polycarboxylic acid and mixtures thereof, optionally the carboxylic acid is further substituted with groups selected from a hydroxyl group, an ester and mixtures thereof; and d) a solvent.

The solvent is exchanged with an oil of lubricating viscosity after the formation of a solid thickener and the solvent can removed by evaporation, filtration or mixtures thereof. Solvents suitable for forming the metal hydroxide desiccated dispersion of the invention include distilled water, water, acetone, and lower alcohols. Typically lower alcohols have 1 to about 5 carbon atoms, preferably 1 to about 3 carbon atoms. The Exemplary examples include methanol, ethanol, propan-1-ol, propan-2-ol and prop-1-enol. In some instances the carbon chains can have additional substitutions such halogens or additional hydroxy functionality.

The solvent content of said desiccated dispersion of metal hydroxide is about 0.1 to about 20, preferably about 0.2 to about 10, most preferably about 0.3 to about 5 weight percent based on the weight of metal hydroxide.

Said method of producing a grease composition allows for less severe reaction conditions compared to known method. As a consequence the reaction temperature to form the metal salt of the carboxylic acid grease thickener metal soap may be reduced to a temperature in the range of about 80 to about 250° C., preferably about 80 to about 215° C., more preferably about 90 to about 190° C., even more preferably about 110 to about 180° C. and most preferably about 120 to about 170° C. In one embodiment the reaction temperature is in the range of about 90 to about 240° C. In one embodiment the reaction temperature is in the range of about 110 to about 230° C. In one embodiment the reaction temperature is in the range of about 120 to about 225° C.

Said method of producing a grease composition or the metal salt component thereof wherein the reaction time is reduced by about 20 to about 90, preferably about 30 to about 80, more preferably about 35 to about 70, even more preferably about 40 to about 60 and most preferably about 45 to about 55 percent as compared to a control using a powdered form of said metal hydroxide. Those skilled in the art will appreciate that the reduction in reaction time is related to the degree of hydration of the metal hydroxide and the surface area of the dispersed phase. Higher degrees of hydration will slow the rate of reaction. Thus, the presence of excessively hydrated metal hydroxide is preferably avoided herein to ensure the reduction in reaction time.

Said method of producing a grease composition wherein the amount of foam produced is reduced by about 2 to about 100, preferably about 20 to about 95, more preferably about 30 to about 90, even more preferably about 35 to about 85 and most preferably about 40 to about 80 percent by volume as compared to a control using a powdered form of said metal hydroxide.

Said method of producing a grease composition wherein the process can be either a batch, semi continuous or a non-batch process. Preferably the grease composition is prepared using non-batch or semi continuous processes. In one embodiment the grease composition is prepared using semi continuous process.

The method of preparing a grease composition of the invention wherein the grease yield value is increased per gram of metal hydroxide and gram of carboxylic acid containing about 2 to about 30 carbon atoms for any NLGI grades 1-6 achieved with at least about 8, preferably at least about 6, more preferably at least about 4 and most preferably at least about 2 percent by weight less of said metal hydroxide as compared to a control of the same grade prepared from the same chemical using a powdered form of said metal hydroxide.

The method of preparing a solid grease thickener for a grease composition can be accomplished in the presence of a solvent but in the absence of the oil of lubricating viscosity (sometimes done where it is not desirable to have the oil of lubricating viscosity present while forming the thickener). The solvent can then be removed or the oil of lubricating viscosity may be exchanged with the solvent to form a grease.

INDUSTRIAL APPLICATION

The composition of the invention can be used in a variety of known greases including but limited to lithium soap greases made with substantially only monocarboxylic acids, complex soap greases, lithium complex soap greases, calcium soap greases, low noise soap greases are (sometimes characterized by the lack of residual metal hydroxide particles above about 2 micrometres in diameter); and short fiber high soap content greases. Preferably the greases include but limited to lithium soap greases, complex soap greases, lithium complex soap greases, low noise soap greases and short fiber high soap content greases.

Low noise greases are known and are typically used in rolling element bearing applications such as pumps or compressors. Complex soap greases are well known and can be either smooth or show grain. Furthermore, complex greases contain a polycarboxylic acid typically a dicarboxylic acid. Short fiber high soap content greases are known and can be used in specialist applications.

EXAMPLES

The following examples illustrate the invention. It should however be noted that these examples are non exhaustive and not intended to limit the scope of the invention.

Example 1

Preparation of Water in Oil/Desiccated Lithium Hydroxide with 8.2 Weight Percent Anhydrous Lithium Hydroxide About 11 weight percent lithium hydroxide monohydrate solution is prepared in deionized water. The solution is placed into a Waring™ blender with about 24.4 weight percent of polyisobutylene succinicimide (an approximately 1550 molecular weight polyisobutylene succan reacted with triethyltetraamine) to form a polyisobutylene succinicimide solubilized in 100N API Group 2 base oil, 4.05 $mm^2s^{-1}$ (cSt) at 100° C. The overall mixture contains about 6.6 weight percent lithium hydroxide, about 53.41 weight percent deionized water, 9 weight percent of polyisobutylene succinicimide and about 31 weight percent of base oil. The water to oil phase ratio is about 60:40. The Waring™ blender is used to blend the starting material using high shear for about 10 minutes. The sample is cooled for about 10 minutes. The shearing process is repeated twice more until a water in oil emulsion is prepared.

The water in oil emulsion is slowly added into a vacuumed environment at about 110° C. over a period of time to reduce water content to less than 1 weight percent. The final product has about 0 weight percent water, a TBN (total base number) of about 203 mg KOH/g of sample, about 2.4 weight percent lithium corresponding to about 8.2 weight percent of anhydrous lithium hydroxide.

Example 2

Preparation of Water in Oil/Desiccated Lithium Hydroxide with 16.6 Weight Percent Anhydrous Lithium Hydroxide About 19.2 weight percent lithium hydroxide monohydrate solution is prepared in deionized water. The solution is placed into a Waring™ blender with about 24.4 weight percent of polyisobutylene succinicimide (an approximately 1550 molecular weight polyisobutylene succan reacted with triethyltetraamine) to form a polyisobutylene succinicimide solubilized in 100N API Group 2 base oil, 4.05 $mm^2s^{-1}$ (cSt) at 100° C. The overall mixture contains about 11.56 weight percent lithium hydroxide monohydrate, about 48.44 weight percent deionized water, about 9 weight percent of polyisobutylene succinicimide and about 31 weight percent of base oil. The water to oil phase ratio is about 60:40. The Waring™ blender is used to blend the starting material using high shear for 10 minutes. The sample is cooled for 10 minutes. The shearing process is repeated twice more until a water in oil emulsion is prepared.

The water in oil emulsion is slowly added into a vacuumed environment at 110° C. over a period of time to reduce water content to less than 1 weight percent. The final product has about 0 weight percent water, a TBN (total base number) of about 325 mg KOH/g of sample, about 3.74 weight percent lithium corresponding to about 12.78 weight percent of anhydrous lithium hydroxide.

Example 3

Preparation of Grease Using Desiccated Lithium Hydroxide Dispersion

About 46.17 grams of desiccated lithium hydroxide, about 44.17 grams of 12-hydroxystearic acid and about 213.82 grams of 100N API Group 3 base oil, 13 $mm^2s^{-1}$ (cSt) at 100° C. are placed in a 1 kilogram round bottomed glass reaction flask, fitted with a steel stirrer, nitrogen inlet, Dean and Stark attachment with a water cooled glass condenser fitted, and a temperature probe connected to an electronic temperature control device. The contents of the flask are stirred at about 500 rpm at about 80° C. Upon soap formation stirrer speed is increased to 1000 rpm and the temperature is increased to about 215° C. at a rate of about 5° C. per minute. The temperature is kept constant at about 215° C. for about 15 minutes. About 45.1 of soap form in about 59.5 g of a 100N API Group 3 base oil, 13 $mm^2s^{-1}$ (cSt) at 100° C. base oil is added over a period of about 10 minutes and the temperature is decreased to about 188° C. where the reaction mixture becomes immobile due to soap formation. The temperature is decreased to about 150° C., where about 161.5 g of finishing oil (100N API Group 3 base oil, 13 $mm^2s^{-1}$ (cSt) at 100° C.) is added over a period of about 10 minutes. The reaction is then allowed to cool to about 80° C. and milled.

The reaction described above produces a NLGI number 3 grease with a reaction time of about 105 minutes, minimal foaming during formation, lower than expected soap content of about 8.3 percent, $WP_{60}$=235 $mm^{-1}$ and a Dropping Point of about 200° C. The Dropping Point method is described in ASTM D2265.

Comparative Example for Example 3

Grease Produced by Conventional Lithium Hydroxide

About 9.92 grams of lithium hydroxide monohydrate, about 67.6 grams of 12-hydroxystearic acid and about 320.1 grams of 100N API Group 3 base oil, 13 $mm^2s^{-1}$ (cSt) at 100° C. are placed in a 1 kilogram round bottomed glass reaction flask fitted with a steel stirrer, nitrogen inlet, Dean and Stark attachment with a water cooled glass condenser fitted, and a temperature probe connected to an electronic temperature control device. The contents of the flask are stirred at about 750 rpm at about 80° C. Upon soap formation stirrer speed is increased to about 900 rpm and the temperature is increased to about 105° C. where high degree of foaming. The temperature is raised to about 115° C. at a rate of about 1° C. per minute. The temperature is increased to about 205° C. at a rate of about 2° C. per minute and held for about 30 minutes. The temperature is increased to about 215° C., where about 119.1 g of soap form in present in a 100N API Group 3 base oil, 13 $mm^2s^{-1}$ (cSt) at 100° C. base oil and added over a period of about 10 minutes.

The temperature is decreased to about 188° C. where the reaction mixture becomes immobile due to soap formation. The temperature is decreased to about 150° C. where about 241.3 g of finishing oil is added over a period of about 10 minutes. The reaction is then allowed to cool to about 80° C.

The reaction described above produces a NLGI number 3 grease with a reaction time of about 185 minutes, high degree of foaming during formation, soap content of 9.2 percent, $WP_{60}$=228 $mm^{-1}$ and a Dropping Point of about 211° C. The Dropping Point method is described in ASTM D2265.

Example 4

Preparation of a Complex Grease Using Desiccated Lithium Hydroxide Dispersion

About 4 g of 12-hydrostearic acid, about 1.88 g of azelaic acid and about 23.51 g of diluent oil are placed into a 250 ml beaker and heated to about 80° C. to dissolve the acids. After the acids have dissolved, about 8.80 g of the desiccated lithium hydroxide is added and the resulting mixture is mixed to form a grease-like material. The beaker is then heated to about 180° C. for about 10 minutes. The reaction is then allowed to cool to about 80° C.

The reaction described above produces a NLGI number 2 grease with little foaming during formation. The soap content is about 15.9 percent and the Dropping Point is over about 285° C.

Test 1—Temperature Programmed Thermal Analysis

Approximately 20 milligram of sample is placed in a sample holder and inserted into a 2950 TGA produced by TA Instruments. The sample is stored under nitrogen at about 30° C. until constant weight. The sample is then heated at about 5° C. per minute up to about 750° C. and constant mass in nitrogen.

The samples tested are (a) lithium hydroxide monohydrate; (b) product formed in Example 1 before vacuuming (undessicated emulsion); (c) dessicated emulsion formed from Example 1 after vacuuming; and (d) dessicated emulsion formed from Example 2 after vacuuming. The thermal analysis results are presented in FIG. 1. The results indicate lithium hydroxide monohydrate loses about 39.5 weight percent at approximately 126° C. and this equates to the removal of water of crystallization. The undessicated emulsion loses about 33 weight percent at approximately 126° C. and this equates to the removal of water of crystallization and other water present from the preparation process. The dessicated emulsion of sample (c) and (d) do not lose water of crystallisation indicating the sample is substantially or wholly anhydrous.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A grease composition comprising the reaction product of:

(a) about 0.5 to about 20 weight percent of a stable dispersion of a metal hydroxide with a number average particle size in the range about 20 nanometres to about 2 micrometres, wherein the metal of the metal hydroxide is present in the range about 2 to about 16 weight percent of the dispersion;

(b) a surfactant with a HLB of less than about 10, wherein the surfactant comprises a derivative of polyisobutylene substituted with succinic anhydride;

(c) about 0.1 to about 30 weight percent of a carboxylic acid containing about 2 to about 30 carbon atoms, wherein the carboxylic acid is selected from a monocarboxylic acid, dicarboxylic acid and mixtures thereof, optionally the carboxylic acid is further substituted with groups selected from a hydroxyl group, an ester formed by the reaction of said carboxylic acid with an alcohol of 1 to about 5 carbon atoms; and mixtures thereof; and (d) about 50 to about 96.5 weight percent of an oil of lubricating viscosity.

2. The composition of claim 1, wherein the metal hydroxide is substantially anhydrous.

3. The composition of claim 1, wherein the metal of the metal hydroxide is an alkali metal, an alkaline earth metal, aluminium or a mixture thereof.

4. The metal hydroxide of claim 1, wherein the metal of the metal hydroxide is an alkali metal or mixture of alkali metals.

5. The composition of claim 1, wherein the carboxylic acid contains about 2 to about 30 carbon atoms, wherein the carboxylic acid is selected from a monocarboxylic acid, dicarboxylic acid and mixtures thereof, optionally the carboxylic acid is further substituted with groups selected from a hydroxyl group, an ester formed by the reaction of said carboxylic acid with an alcohol of 1 to about 5 carbon atoms; and mixtures thereof.

6. The carboxylic acid of claim 5, wherein the carboxylic acid is selected from the group consisting of a substituted or unsubstituted stearic acid.

7. The carboxylic acid of claim 5, wherein the carboxylic acid is a mixture of at least one monocarboxylic acid with nonanedioic acid, decanedioic acid or mixtures thereof.

8. The grease composition of claim 1 further comprising at least one compound selected from the group consisting of an antiwear agent, an antioxidant, a metal deactivator, a rust inhibitor, a viscosity modifier and an extreme pressure additive.

9. A process of producing a grease composition comprising mixing in any order:

(a) a stable dispersion of metal hydroxide present in the range about 0.5 to about 20 weight percent prepared by removing the solvent from an emulsion of metal hydroxide and solvent in oil;

(b) a carboxylic acid containing about 2 to about 30 carbon atoms, wherein the wherein the carboxylic acid contains about 2 to about 30 carbon atoms, wherein the carboxylic acid is selected from a monocarboxylic acid, dicarboxylic acid and mixtures thereof, optionally the carboxylic acid is further substituted with groups selected from a hydroxyl group, an ester formed by the reaction of said carboxylic acid with an alcohol of 1 to about 5 carbon atoms; and mixtures thereof present in the range about 0.1 to about 30 weight percent, (c) and an oil of lubricating viscosity present in the range about 50 to about 96.5 weight percent to obtain a mixture, said mixture is further treated with a saponification stage; and (d) optionally a finishing amount of oil of lubricating viscosity is added to impart the desired viscosity.

10. The process of claim 9, wherein the solvent content of said dispersion of metal hydroxide is about 0.1 to about 20 weight percent based on the weight of metal hydroxide.

11. The process of claim 9, wherein the reaction time is reduced by about 20 to about 90 percent as compared to a control using a powdered form of said metal hydroxide.

12. The process of claim 9, wherein the reaction temperature is in the range of about 80 to about 215 degrees Celsius.

13. The process of claim 9, wherein the amount of foam produced is reduced by about 20 to about 95 percent as compared to a control using a powdered form of said metal hydroxide.

14. The process of claim 9, wherein the grease composition is prepared by a non-batch process.

15. The process of claim 9, wherein the grease yield value is increased per gram of metal hydroxide and gram of carboxylic acid containing about 2 to about 30 carbon atoms for any NLGI grade 1-6 such that at least about 8 percent by weight less of said metal hydroxide and at least about 8 percent by weight less carboxylic acid is needed to achieve an equivalent yield value as compared to a control of the same grade prepared from the same chemical using a powdered form of said metal hydroxide.

16. A process to prepare a grease thickener comprising the reaction product of:

(a) about 0.5 to about 20 weight percent of a stable dispersion of a metal hydroxide with a number average particle size in the range about 20 nanometres to about 2 micrometres, wherein the metal of the metal hydroxide is present in the range about 2 to about 16 weight percent of the dispersion;

(b) a surfactant with a HLB of less than about 10, wherein the surfactant comprises a derivative of polyisobutylene substituted with succinic anhydride;

(c) about 0.1 to about 30 weight percent of a carboxylic acid containing about 2 to about 30 carbon atoms, wherein the carboxylic acid contains about 2 to about 30 carbon atoms, wherein the carboxylic acid is selected from a monocarboxylic acid, dicarboxylic acid and mixtures thereof, optionally the carboxylic acid is further substituted with groups selected from a hydroxyl group, an ester formed by the reaction of said carboxylic acid with an alcohol of 1 to about 5 carbon atoms; and mixtures thereof; and (d) a solvent.

17. The process of claim 16, wherein the solvent is exchanged with an oil of lubricating viscosity after the formation of a grease thickener and the solvent is removed by evaporation, filtration or mixtures thereof.

18. The process of claim 16, wherein the solvent is selected from the group consisting of water, acetone, lower alcohols containing 1 to about 5 carbon atoms, other hydrocarbyl having a boiling point at 1 atmosphere pressure of less than 150 C and mixtures thereof.

19. The composition of claim 1, wherein said oil of lubricating viscosity comprises a natural oil, comprising one or more animal oils, vegetable oils, or combinations thereof.

* * * * *